US010024316B2

(12) United States Patent
Smith

(10) Patent No.: US 10,024,316 B2
(45) Date of Patent: Jul. 17, 2018

(54) MAGNETIC ANTI-ROTATION DEVICE FOR PUMP ACCESS COVER RETAINER

(71) Applicant: FMC Technologies, Inc., Houston, TX (US)

(72) Inventor: Jason D. Smith, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 247 days.

(21) Appl. No.: 14/892,515

(22) PCT Filed: May 23, 2013

(86) PCT No.: PCT/US2013/042423
§ 371 (c)(1),
(2) Date: Nov. 19, 2015

(87) PCT Pub. No.: WO2014/189514
PCT Pub. Date: Nov. 27, 2014

(65) Prior Publication Data

US 2016/0108910 A1 Apr. 21, 2016

(51) Int. Cl.
*F04B 53/22* (2006.01)
*F04B 53/16* (2006.01)
*F04B 53/00* (2006.01)

(52) U.S. Cl.
CPC ..... *F04B 53/16* (2013.01); *F04B 53/007* (2013.01); *F04B 53/22* (2013.01)

(58) Field of Classification Search
CPC ..... F04B 53/007; F04B 53/22
(Continued)

(56) References Cited

U.S. PATENT DOCUMENTS 5,125,808 A 6/1992 Sekiguchi
2003/0235508 A1 12/2003 Vicars
(Continued)

FOREIGN PATENT DOCUMENTS

EP 0705387 4/1996
JP H11351153 A 12/1999

OTHER PUBLICATIONS

Office Action issued in Canadian Application No. 2,913,114; dated Sep. 26, 2016 (6 pages).
(Continued)

*Primary Examiner* — F. Daniel Lopez
*Assistant Examiner* — Daniel Collins
(74) *Attorney, Agent, or Firm* — Osha Liang LLP

(57) ABSTRACT

An apparatus to block an access port of a pump includes a cover having a distal end and a proximal end, wherein the distal end is configured to be received into the access port, an indexing device to prevent rotation of the cover with respect to the access port, a first component of an anti-rotation mechanism located upon the proximal end of the cover, a retainer configured to rotatably engage and abut the proximal end of the cover to resist removal of the cover from the access port, a key to engage the proximal end of the cover through a profiled keyway of the retainer, wherein the key comprises a second component of the anti-rotation mechanism, and at least one magnet to retain the key against the proximal end of the cover, wherein the profiled keyway is configured to restrict rotation of the key with respect to the retainer.

18 Claims, 9 Drawing Sheets

(58) Field of Classification Search
USPC ..... 92/171.1
See application file for complete search history.

(56) References Cited

U.S. PATENT DOCUMENTS

| | | | | |
|---|---|---|---|---|
| 2005/0201881 | A1* | 9/2005 | Jensen | F04B 53/007 417/529 |
| 2010/0143163 | A1 | 6/2010 | Patel et al. | |
| 2011/0189040 | A1 | 8/2011 | Vicars | |

OTHER PUBLICATIONS

Office Action issued in Chinese Application No. 201380078351.8; dated Oct. 8, 2016 (6 pages).
Patent Examination Report No. 1 dated Jul. 7, 2016, by the Australian Patent Office in related Australian Patent Application No. 2013390033 (3 pages).
Office Action issued in Russian Application No. 2015154962 dated May 22, 2017 (9 pages).
International Search Report issued in PCT/US2013/042423 dated Sep. 12, 2013 (2 pages).
Written Opinion of the International Searching Authority issued in PCT/US2013/042423 dated Sep. 12, 2013 (6 pages).

* cited by examiner

MAGNETIC ANTI-ROTATION DEVICE FOR PUMP ACCESS COVER RETAINER

BACKGROUND OF THE DISCLOSURE

Field of the Disclosure

Embodiments disclosed herein relate to methods and apparatuses to removably cover service access ports of industrial machines. More particularly, embodiments disclosed herein relate to apparatuses and methods to removably cover service access ports of hydraulic industrial machines and pumps. More particularly still, embodiments disclosed herein relate to apparatuses and methods to retain vibration resistant service access covers within service access ports of oilfield pumps.

Description of the Related Art

Well service pumps, commonly known in the oilfield industry as "mud pumps," are ubiquitous in oilfield drilling and exploration operations. In general, well service pumps are frequently used to supply fluids to remote destinations (e.g., deep wellbore locations) at pressures exceeding 20,000 psi (138 kPa). Most commonly, well service pumps are used to transmit drilling fluid, commonly referred to as "mud," from a surface holding tank, through a central bore of a plurality of threaded drill pipes to a drill bit located at the bottom of the wellbore.

Once at drill bit, the pressurized mud is allowed to flow over cutting surfaces of the drill bit and "wash" the freshly-cut wellbore formation. Following exit through nozzles of the drill bit, the pressurized mud escapes up the wellbore and back toward the surface through a wellbore annulus formed between the outer diameter of the drillstring and the inner diameter of the (cased or uncased) wellbore. Because the annular area between the drillstring and the wellbore is greater than that of the central bore, the mud returns at a pressure that is reduced from its delivery pressure. Additionally, as the returning mud is used to remove drill cuttings and other entrained solids from the wellbore, it must be filtered as it is collected at the surface before it may be returned to the holding tank for a return trip downhole.

Mud pumps, as most commonly deployed in the oilfield industry, are typically constructed as multi-cylinder reciprocating pumps, although some circumferential or positive-displacement pumps have been used. Typically, oilfield mud pumps come in either the triplex (i.e., three cylinder) or the quintuplex (i.e., five cylinder) varieties, whereby each "cylinder" comprises a suction end and a discharge end. Ordinarily, a pair of one-way check-type valves are situated between the suction and discharge ends of each cylinder and are arranged such that fluid is drawn into the cylinder from the suction end through a first check valve, and then forced from the cylinder to the discharge end through a second check valve. A motor-driven plunger (i.e., piston) reciprocates within the cylinder alternating suction and discharge strokes with each complete rotation cycle of the crankshaft. Typically, the multiple cylinders of a multi-cylinder mud pump are timed such that the overall output of the pump is balanced and does not represent the overall pulsed nature that would be exhibited by a single-cylinder check valve pump.

Referring now to FIG. 1, a mud pump assembly 100 as would be commonly known in the prior art is shown. As depicted, mud pump 100 includes a power end 102 and a fluid end 104. As would be understood by those having ordinary skill, the power end 102 comprises the driving assembly including an electric motor, a transmission (e.g., gear reducer) apparatus, and a crankcase housing a crankshaft and a plurality of connecting rods. In operation, the electric motor drives the transmission which, in turn, rotates the crankshaft attached to each of the (in this example) three piston plungers that reciprocate into and out of fluid end 104 of the mud pump 100. As a result, drilling mud (or any other fluid to be pumped) is drawn into cylinders of fluid end 102 through an inlet or suction manifold 106 and is discharged (under pressure) through a discharge outlet 108. Finally, as can be seen in FIG. 1, a plurality of access ports 110, 112 are located within fluid end 104 of mud pump 100 to allow access to either the suction, discharge, or cylinder components of mud pump 100. As shown, ports 112 allow access to the discharge end of fluid end 104, while ports 110 allow access to the cylinder portions of fluid end 104. A gauge connection 114 is shown located within port 112*a* corresponding to the middle cylinder of discharge end of fluid end 104 of mud pump 100.

Referring now to FIG. 2 (alongside FIG. 1), a sectioned view of the fluid end 104 of pump 100 is shown. As one having ordinary skill would understand, a plunger 120, connected to a rod of power end 102 of pump 100 at threaded connection 122 reciprocates within a cylinder 124 through a dynamic hydraulic seal 126. As plunger 120 is pulled out of cylinder 124 by a rod of power end 102 (FIG. 1), suction is created in cylinder 124 and fluid is drawn into cylinder 124 through suction valve 128 from suction manifold 106. Next, as power end 102 (FIG. 1) of pump 100 thrusts piston 120 back into cylinder 124, the fluid suctioned from manifold 106 through valve 128 is discharged through discharge valve 130 and into discharge manifold 108. As described above, valves 128 and 130 are one-way check-type valves that are oriented so as to only allow fluid to flow in the direction from suction manifold 106 to cylinder 124, and then out through discharge 108. As such, during the suction stroke of plunger 120, valve 130 restricts fluid from flowing from discharge 108 to cylinder 124, and during the discharge stroke of plunger 120, valve 128 restricts fluid from flowing from cylinder 124 to suction manifold 106.

In order to service mud pump 100, a plurality of service ports 110, 112 are located throughout the main body of fluid end 104 of pump 100. As shown in FIG. 2, a service port 110 is shown allowing access to cylinder 124, plunger 120, and check valves 128 and 130. For each service access port 110, 112, mud pump assembly 100 includes a cover assembly that is used to hydraulically block and seal access ports 110, 112 so that fluid end 104 of pump 100 may maintain hydraulic integrity while in service, while still allowing easy removal of the cover assemblies in the event that a quick servicing or repair operation is necessary.

As shown in the prior art mud pump assembly 100 of FIGS. 1 and 2, the service cover assembly includes a cover 132 and a threaded retainer 134. In operation, a seal member 136 is placed about cover 132 and is used to form a hydraulic seal between a cover 132 and body of fluid end 104 to isolate cylinder 124 from the outside. Following the insertion of cover 132 into port 110, threaded retainer 134 is installed behind cover 132 and is threaded and torqued into compressive engagement with a rear or proximal end of cover 132 to counteract any pressure inside of cylinder 124 that might otherwise urge cover 132 out of port 110. A hex wrenching feature 138 is machined into the rear end of retainer 134 so that sufficient tightening torque can be applied to retainer 134 to impart a sufficient pre-load to hold cover 132 in place and to counteract hydraulic pressure within cylinder 124. Finally, a threaded bolt 140 may be used to tighten the connection between retainer 134 and cover 132 and resist any "backing up" of threaded retainer 134 away from cover 132 as a result of vibrations coming from mud pump 100 or any surrounding equipment. As would be understood by those having ordinary skill in the art, the threads of retainer 134 and bolt 140 may be machined in opposite tightening directions such that vibrations tending to loosen one of cover 132 and bolt 140 will act to tighten the other, offering further vibration loosening resistance to cover mechanism.

However, as those having ordinary skill in the art will appreciate, vibrations on reciprocating and rotating oilfield equipment are seldom consistent in magnitude or direction. Therefore, in the design shown in FIGS. 1 and 2, it is possible for there to exist a first vibration condition to loosen bolt 140 first, followed by a second vibration condition tending to loosen retainer 134. Therefore, an access cover mechanism capable of resisting various vibration conditions simultaneously is desirable.

SUMMARY OF THE CLAIMED SUBJECT MATTER

In one aspect, the present disclosure relates to an apparatus to block an access port of a pump including a cover having a distal end and a proximal end, wherein the distal end is configured to be received into the access port, an indexing device to prevent rotation of the cover with respect to the access port, a first component of an anti-rotation mechanism located upon the proximal end of the cover, a retainer configured to rotatably engage the proximal end of the cover to resist removal of the cover from the access port, a key to engage the proximal end of the cover through a profiled keyway of the retainer, wherein the key comprises a second component of the anti-rotation mechanism, and at least one magnet to retain the key against the proximal end of the cover, wherein the profiled keyway is configured to restrict rotation of the key with respect to the retainer.

In another aspect, the present disclosure relates to a method to block an access port of a pump including engaging a cover into the access port, restricting rotation of the cover with respect to the access port with an indexing device, rotatably engaging the cover with a retainer, engaging a key with the cover through a profiled keyway of the retainer, restricting rotation between the key and the cover with an anti-rotation mechanism, and restricting rotation between the key and the retainer with the profiled keyway.

In another aspect, the present disclosure relates to an apparatus to block an access port of a pump including a cover having a distal end and a proximal end, wherein the distal end is configured to be received into the access port, a first means for preventing rotation of the cover with respect to the access port, a first component of a second means for preventing rotation located upon the proximal end of the cover, a retainer configured to rotatably engage and abut the proximal end of the cover to resist removal of the cover from the access port, a key to engage the proximal end of the cover through a profiled keyway of the retainer, wherein the key comprises a second component of second means for preventing rotation, wherein the profiled keyway is configured to restrict rotation of the key with respect to the retainer.

BRIEF DESCRIPTION OF DRAWINGS

Features of the present disclosure will become more apparent from the following description in conjunction with the accompanying drawings.

DETAILED DESCRIPTION

Selected embodiments disclosed herein relate to assemblies and methods to block access ports of industrial machines including, but not limited to, oilfield well service or mud pumps. As such, selected embodiments disclosed herein relate to assemblies and methods to block access ports including a cover having an indexing device, a retainer having a profiled keyway, a key, and an anti-rotation mechanism, whereby the anti-rotation mechanism restricts rotation between the key and the cover, the indexing device restricts rotation between the cover and the access port, and the profiled keyway restricts rotation between the key and the retainer. Additionally, selected embodiments disclosed herein relate to assemblies and methods including a magnet to retain the key against a rear or proximal end of the cover to maintain the anti-rotation mechanism.

Figure 3A:
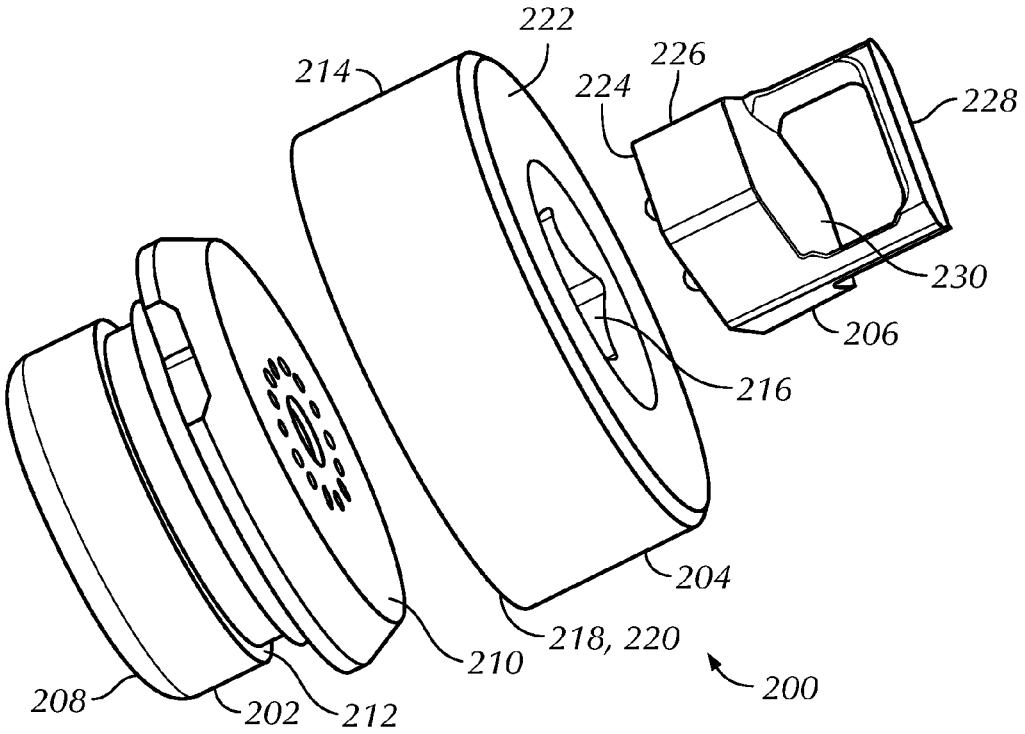
FIGS. 3A and 3B are schematic profiled view drawings of an access port cover assembly in accordance with one or more embodiments disclosed herein.
Figure 3B:
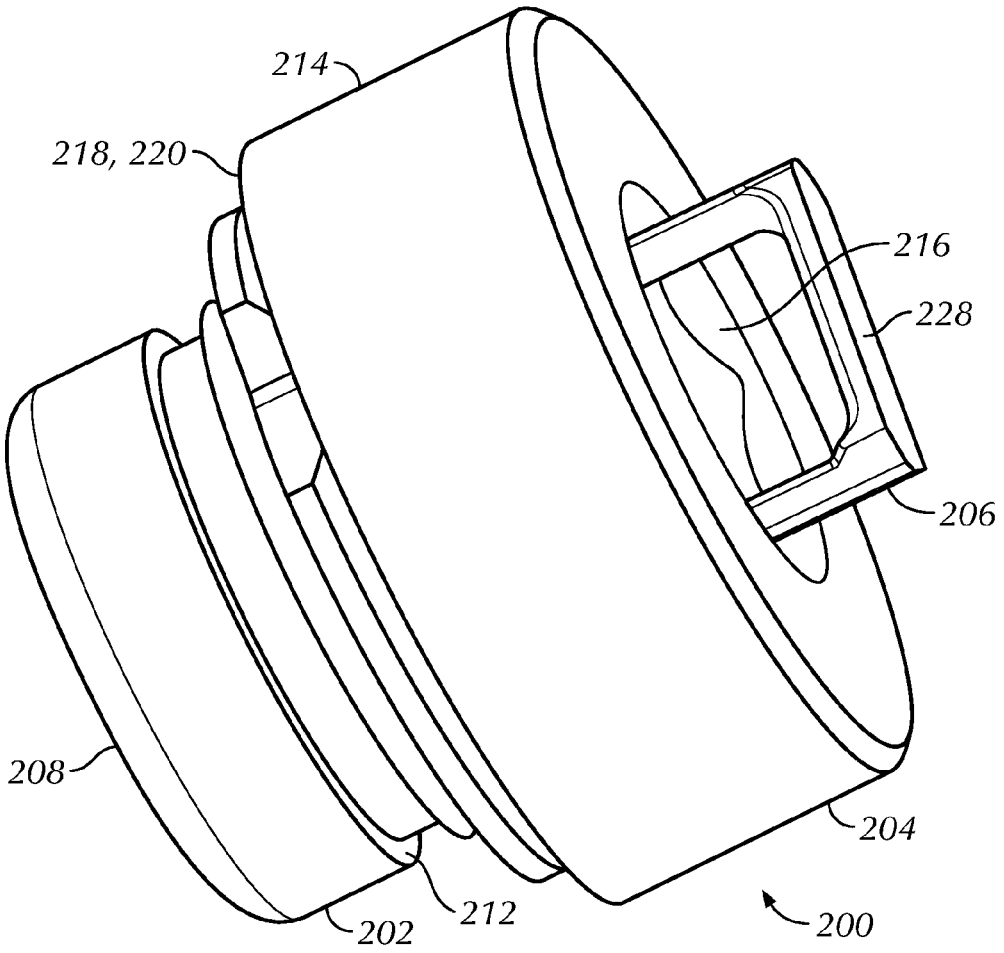

Referring now to FIGS. 3A and 3B, a cover assembly 200 for an industrial machine is shown in exploded (FIG. 3A) and assembled (FIG. 3B) schematic views. As shown, cover assembly 200 includes a cover or cover body 202, a threaded retainer 204 and a key 206. In service, cover 202 is engaged within an access port (e.g., 238 of FIG. 7) and secured in place from behind by retainer 204. Following engagement of retainer 204 behind cover 202, key 206 is engaged through retainer 204 and into cover 202 to prevent retainer 204 from rotating with respect to cover 202.

Cover assembly 200 may be used with a well service pump, mud pump, or any other type of industrial machine having an access port where resistance to mechanical and hydraulic vibrations is desirable. As shown, cover 202 includes a distal end 208, a proximal end 210, and a seal groove 212. Additionally, retainer 204 includes an outer profile 214, a profiled keyway 216, a distal end 218 comprising a bearing surface 220, and a proximal end 222. Finally, key 206 is depicted in FIGS. 3A and 3B as having a distal end 224, an outer profile 226, and a handle 228 extending from a proximal end 230.

Figure 4:
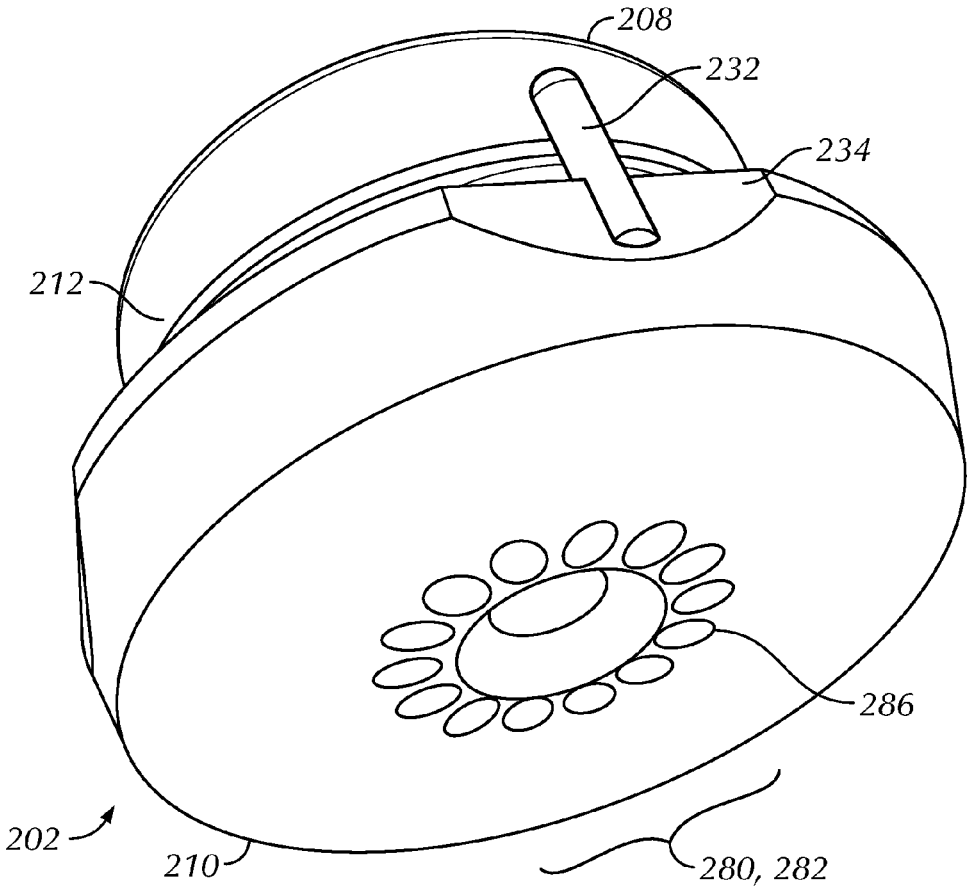
FIG. 4 is a profiled view drawing of an access cover of the assembly of FIGS. 3A and 3B.

Referring now to FIGS. 4-7, the components of cover assembly 200 can be viewed and described in more detail. As shown in FIG. 4 and described above, cover 202 includes a distal end 208 and a proximal end 210. Distal or insertion end 208 of cover 202 is preferably sized and shaped to be sealingly engaged within an access port of an industrial machine (e.g., a mud pump). While distal and proximal ends 208, 210 of cover 202 are shown as generally circular, it should be understood by those having ordinary skill that any shape or profile of access port may be accommodated using a similar or correspondingly shaped cover 202.

Furthermore, while cover 202 is disclosed as including a seal groove 212 upon the outer diameter of a diametrically smaller distal end 208, it should be understood by those having ordinary skill that, depending on the specific configuration of the port of the particular industrial machine to be covered, that seal groove 212 may be located nearer to proximal end 210, on a shoulder or flange (not visible) between larger proximal end 210 and smaller distal end 208, on a distal end that is diametrically similar or larger than proximal end 210, or may not be used at all for applications where hydraulic sealing between cover 202 and machine is not necessary. As such, seal groove 212 may be designed to accommodate any type of seal member known to those having ordinary skill including, but not limited to, face seals, male gland radial seals (as shown in FIG. 4), and female gland radial seals. Alternatively still, it should be understood that in certain embodiments, cover 202 may instead include a surface configured to engage a seal member of the corresponding access port of the industrial machine.

Figure 7:
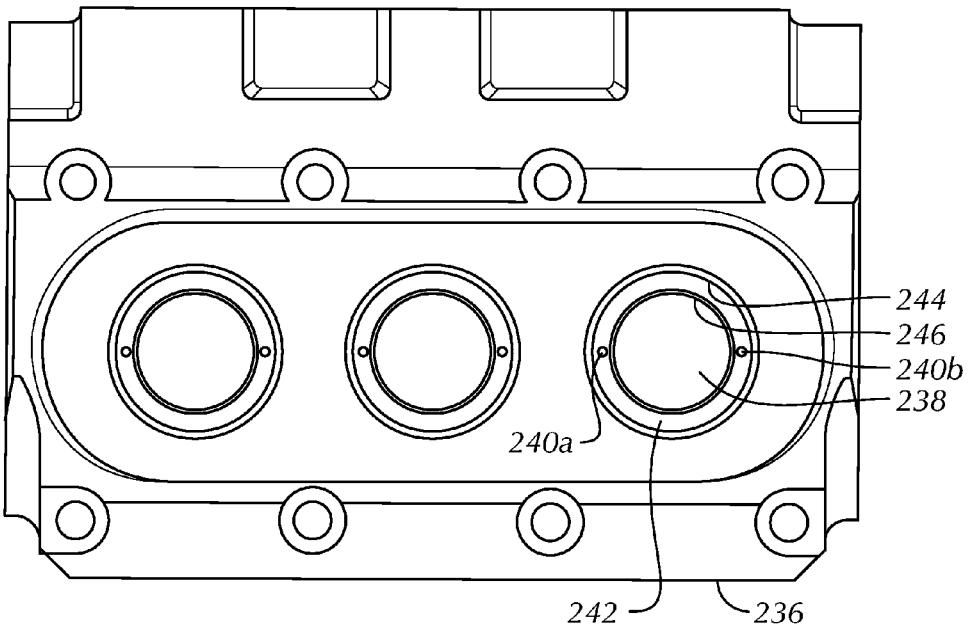
FIG. 7 is a schematic view drawing of a fluid end of a well service pump in accordance with one or more embodiments disclosed herein.

Referring still to FIG. 4, cover 202 is shown having one or more indexing devices in the form of dowel pins 232, machined flats 234 on outer diameter of cover 202, or any other features (e.g., threaded studs or bolts) known to those having ordinary skill to restrict the rotation of cover 202 about its center axis relative to an access port into which it is installed. Referring briefly to FIG. 7, a body 236 of a fluid end of a well service pump is shown having a generally circular access port 238 comprising a first or through bore 246 and a second or counter bore 244. A pair of dowel holes 240A, 240B are shown positioned within a rabbet 242 (i.e., a counter bore ledge) created between through bore 246 and counter bore 244 and located approximately 180° apart about a central axis of bores 244 and 246.

While access port 238 is shown having two dowel holes 240A, 240B, it should be understood by those having ordinary skill that any number of dowels in various orientations may be used with cover 202 and port 238 to restrict rotation therebetween without departing from the scope of the claimed subject matter. Alternatively, other features including, but not limited to, machined flats, polygonal profiles, and the like may be used upon cover 202 and within corresponding features of port 238 (e.g., in counter bore 244) to restrict rotation of cover 202 installed within port 238, as would be understood by those having ordinary skill.

Referring now to FIGS. 4 and 7 together, cover 202 may be placed within an available access port (e.g., 238) of body 236 such that indexing devices (e.g., dowel pins 232 and dowel holes 240) are aligned as distal end 208 of cover 202 is engaged into through bore 246 of body 236. As distal end 208 of cover 202 is engaged into through bore 246, a seal member (if present) compresses and engages with a corresponding seal surface (not shown) of through bore 246. As distal end 208 of cover 202 is further engaged within bore 246, an operator rotates cover 202 such that aligned dowels 232 engage holes 240. Once so aligned, cover 202 may be further engaged into port 238 until the aforementioned shoulder between distal 208 and proximal 210 ends of cover 202 seats into rabbet 242. Once so seated, the seal situated within groove 212 is able to seal against through bore 246 such that the interior of the industrial machine is hydraulically isolated from the exterior of port 238. As such, cover 202 is now ready to be secured in place by the remainder of the cover assembly 200.

Figure 5:
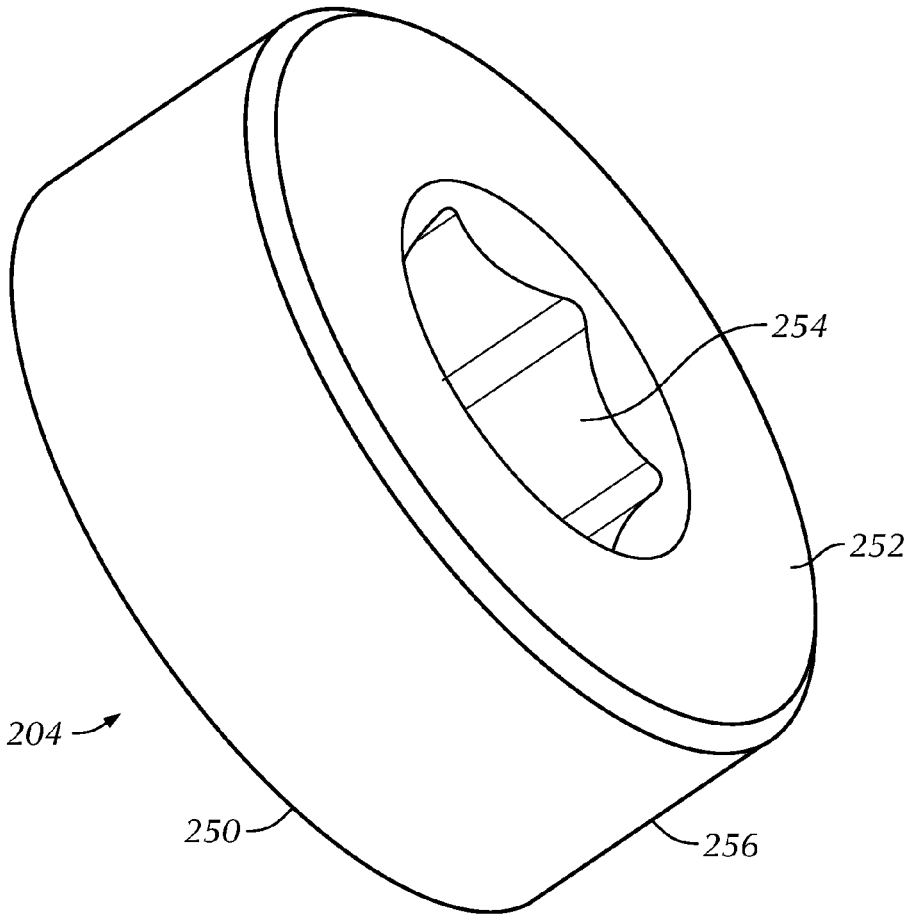
FIG. 5 is a profiled view drawing of a retainer of the assembly of FIGS. 3A and 3B.

Referring now to FIG. 5, a retainer 204 in accordance with one or more embodiments disclosed herein is shown schematically. Retainer 204 includes a distal end 250, a proximal end 252, a profiled keyway 254, and a threaded outer profile 256. While threaded outer profile 256 is shown schematically, it should be understood by those having ordinary skill that any load-bearing rotary threading or connecting mechanism known in the art may be used for outer profile 256 for securing retainer 204 within counter bore 244 of port 238. As such, counter bore 244 may comprise corresponding connecting mechanism features (e.g., female threads, etc.) configured to receive and/or retain outer profile 256 of retainer 204.

As cover assembly 200 is designed to work with a variety of pre-existing industrial machine designs, the particulars of how a cover (e.g., 202 of FIG. 4) is to be held in place by a retainer (e.g., 204 of FIG. 5) is likely to be dictated by the features (e.g., counter bore 244) already in place. Therefore, the types and styles of "threads" used for outer profile 256 (and corresponding counter bore 244 of port 238 shown in FIG. 7) may include, but should not be limited to, single-point threads, multi-point threads, multi or single-point quarter-turn threads, acme threads, buttress threads, bayonet connections, j-slot connections, and the like. Regardless of the type and style of connection mechanism, threaded or otherwise, between counter bore 244 and retainer 204, a person having ordinary skill would understand retainer 204 to be engagable with counter bore 244 in such fashion as to apply force to proximal end 210 of cover 202 significant enough to resist counteractive forces and vibrations resulting from internal pressure of industrial machine acting upon distal end 208 of cover 202.

Additionally, the configuration of profiled keyway 254 of retainer 204 is selected to receive a corresponding key (206 of FIGS. 3 and 6) so that retainer 204 may be tightened and restricted from rotating out of engagement (e.g., through vibrations, etc.) with proximal end 210 of cover 202 or counter bore 244 of the industrial machine. While profiled keyway 254 is shown in FIG. 5 to be a regular hexagonal shape, it should be understood that any profile capable of transmitting torque between keyway 254 and corresponding key 206 may be used including, but not limited to rectangular, square, polygonal, oval, cross-shaped patterns, or a combination thereof. While any shape and size profile may be used, a person having ordinary skill will appreciate favoring some profiles over others for the purpose of reducing machining costs, and maximizing the amount of torque that may be transmitted therewith.

Figure 6:
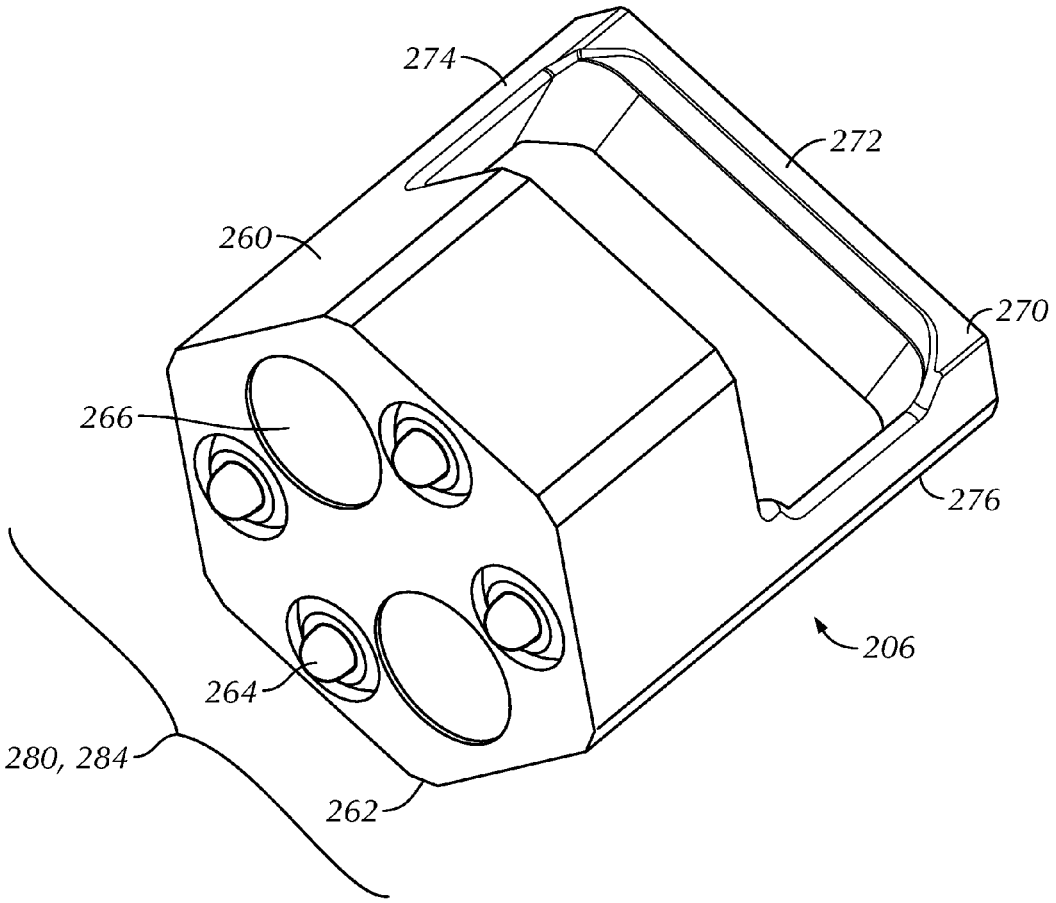
FIG. 6 is a profiled view drawing of a key of the assembly of FIGS. 3A and 3B.

Referring now to FIG. 6, a key 206 corresponding to profiled keyway 254 of retainer 204 of FIG. 5 in accordance with one or more embodiments disclosed herein is shown. As shown, key 206 comprises a generally hexagonally-shaped main body 260, a distal end 262 comprising one or more spring plungers 264 and one or more magnets 266. Extending from a proximal end of key 206, a handle 270 provides a gripping surface 272 and two extension aims 274, 276. In operation, gripping surface 272 of handle 270 may be used by an operator to install, remove, or rotate key 206 in either direction, and a "cheater" or torqueing bar (not shown) may be inserted into the aperture created between face 268, extension arms 274, 276, and grip 272 to allow additional torque through mechanical advantage to tighten or loosen any device (e.g., retainer 204) into which key 206 is engaged.

Referring now to FIGS. 4 and 6 together, first 282 and second 284 components of an anti-rotation mechanism 280 may be described. Anti-rotation mechanism 280 is provided as a mechanism to restrict relative rotation between key 206 and cover 202 when cover 202, retainer 204, and key 206 are installed together within and for the purpose of blocking access port 238 of the industrial machine. As such, with indexing device (e.g., pins 232 and holes 240, respectively of FIGS. 4 and 7) restricting rotation of cover 202 relative to access port 238, profiled keyway 254 and outer profile of main body 260 (shown in FIGS. 5 and 6, respectively) restricting rotation between key 206 and retainer 204, and anti-rotation mechanism 280 restricting rotation between key 206 and cover 202, cover assembly (200 of FIGS. 3A and 3B) is unable to be disassembled, either intentionally or unintentionally, without removal of key 206 from keyway 254 of retainer 204 to allow unthreading and removal of retainer 204 from counter bore 244 of port 238.

As shown in FIGS. 4 and 6, anti-rotation mechanism 280 comprises two components, a first component 282 upon proximal end 210 of cover 202, and a second component 284 upon distal end of key 206. In the example depicted in FIGS. 3-7, profiled keyway 254 fully extends between proximal 252 and distal 250 ends of retainer 204 to allow second component 284 of anti-rotation mechanism 280 on distal end 262 of key 206 to fully interact with first component 282 of proximal end 210 of cover 202. While one particular example of anti-rotation mechanism 280 is depicted, it should be understood that various other types of anti-rotation mechanism 280 may be used with cover assembly 200 without departing from the claimed subject matter. For example, anti-rotation mechanisms whereby keyway 254 only partially extends through retainer 204, or mechanisms whereby key 206 only indirectly interacts (e.g., through an intermediate component of retainer 204 or cover 202) with a first component of cover 202 may be used as well.

Nonetheless, as shown in FIG. 4, first component 282 of anti-rotation mechanism 208 comprises a plurality of radial slots 286 extending about a center of proximal end 210 of cover 202 in a generally circular pattern. While anti-rotation mechanism 208 is shown as including a plurality of radial slots 286, it should be understood that any type, size, or geometry of aperture or arrangement of apertures may be used without departing from the scope of the claimed subject matter. Additionally, while first component 282 is shown as including 14 radial slots 286, accounting for a 25.7° (i.e, 360°÷14) angular offset between positions, it should be understood that increased or decreased "resolutions" may be used as needed to allow sufficient alignment and retaining positions between key 206 and cover 202. Correspondingly, second component 284 of anti-rotation mechanism 280 comprises one or more spring plungers 264 and one or more magnets 266 as described above. Magnets 266 and spring plungers 264 may be press-fit, welded, adhered, or threaded within distal end 262 of key 206 and may be configured to align with and rotationally lock key 206 to cover 202.

Similarly, as main body 260 of key 206 and profiled keyway 254 of retainer 204 are depicted as hexagonal, alignment of key 206 within retainer 204 will exhibit a 60° (i.e., 360°÷6) angular offset between positions. Thus, with the resolution (60°) of second component 284 not being an even multiple of first component 282 (25.7°), different "fit" states between first and second components of anti-rotation mechanism 280 exist for each of the six positions of key 206 within retainer 204. Thus, should a first attempt at engaging second component 284 with first component 282 not achieve a desired fit state (e.g., distal end 262 of key 206 being flush with proximal end 210 of cover 202), an operator may rotate key 206 to the next position to attempt to achieve the desired fit state. This process may be repeated four more times to determine the best fit state between key 206 and cover 202 through retainer 204.

Figure 8:
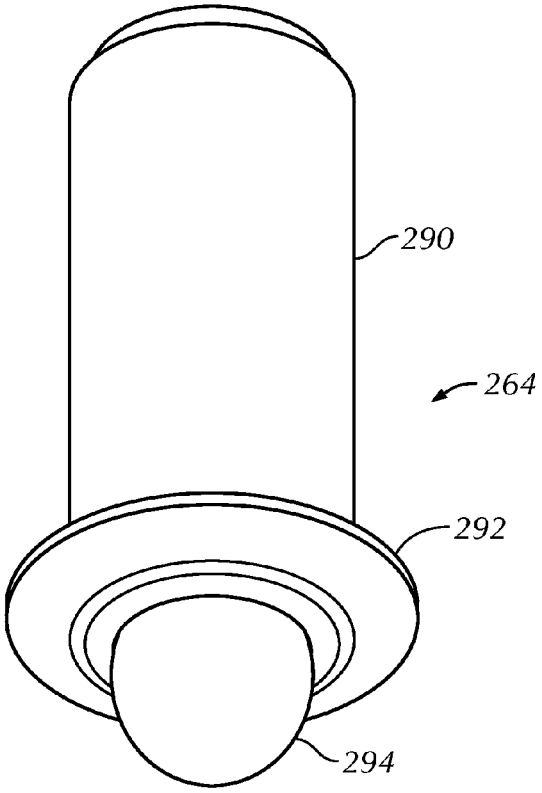
FIG. 8 is a profiled view drawing of a spring plunger in accordance with one or more embodiments disclosed herein.

Referring briefly to FIG. 8, a spring plunger 264 in accordance with at least one embodiment disclosed herein is shown. As shown, spring plunger 264 comprises a generally tubular main body 290, a stop flange 292, and a generally spherically-shaped plunger ball 294. In one or more embodiments, a spring biasing mechanism (not shown) internal to the tubular main body 290 biases plunger ball 294 in a direction away from main body 290. Thus, when installed within distal end 262 of key 206, plunger balls 294 of spring plungers 264 may compress into tubular main body 294 should a misalignment between plunger 264 and radial slots 286 occur. Should such misalignment result in an undesired fit between cover 202 and key 206, an operator may attempt to correct the fit by either rotating retainer 204 slightly or by rotating key 206 to another position (as described above) within profiled keyway 254. It should be understood that as installed, retainer may either be rotated in the tightening or loosening direction to align anti-rotation mechanism 280, and that such rotation may be facilitated either by a wrenching feature (not shown) of retainer 204 itself, or by torquing key 206 (in-situ within profiled keyway 254) with a wrenching or cheater bar as described above. Additionally, the "diameter" of plunger ball 294 may be sized to be smaller than the corresponding width or diameter of slots 286 to allow additional tolerance in the fit between first 282 and second 284 components of anti-rotation mechanism 280.

Figure 9:
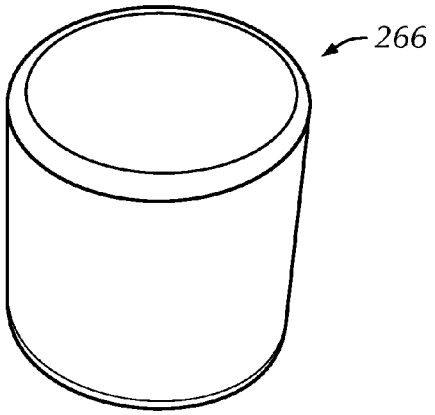
FIG. 9 is a profiled view drawing of a magnet in accordance with one or more embodiments disclosed herein.

Once the alignment between spring plungers 264 of key 206 and radial slots 286 of cover 202 have been deemed to be acceptable (i.e., proper alignment and engagement between first 282 and second 284 components of anti-rotation mechanism 280), the spherical "sides" of plunger balls 294 engaged within radial slots 286 prevent rotation between components 282,284 of anti-rotation mechanism 280 and therefore restrict rotation of key 206 with respect to cover 202. Once so engaged, one or more magnets 266, an example of which is shown in detail in FIG. 9, may be used to maintain key 206 in its position against the proximal end 210 of cover 202. As would be known to those having ordinary skill in the art, the number, type, and composition of magnets 266 may be varied depending on the mass of key 206, the spring rate of spring plungers 264, and the desired amount of axial holding force desired to be overcome to remove key 206 from profiled keyway 254 of retainer 204.

Furthermore, while one example of an anti-rotation mechanism 280 is depicted here, it should be understood by those having ordinary skill that various other mechanisms may be used without departing from the claimed invention. For example, in an alternative embodiment, the magnets and/or the spring plungers may be located on cover 202 with radial slots located on key 206. Moreover, any number of spring plungers 264 and magnets 266 may be used. Alternatively still, rigid or non-spring actuated plungers (e.g., dowel pins) may be used in place of spring plungers 264. Finally, a captive quarter-turn mechanical fastener (or the like) may be used to maintain key 206 up against proximal end 210 of cover 202.

Figure 1:
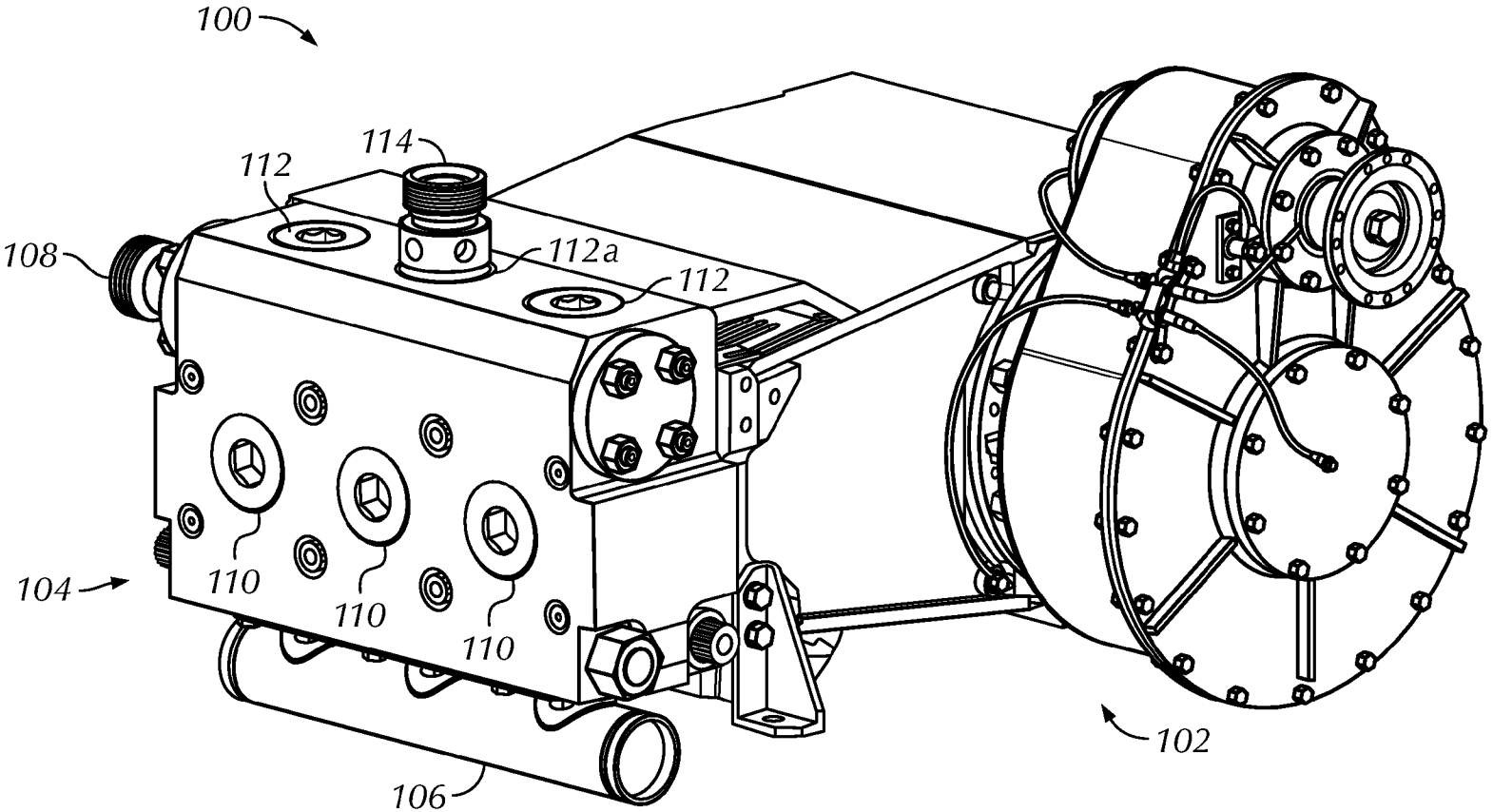
FIG. 1 (Prior Art)
FIG. 1 is a schematic profiled view drawing of a typical well service pump assembly in accordance with those known to exist in the prior art.
Figure 2:
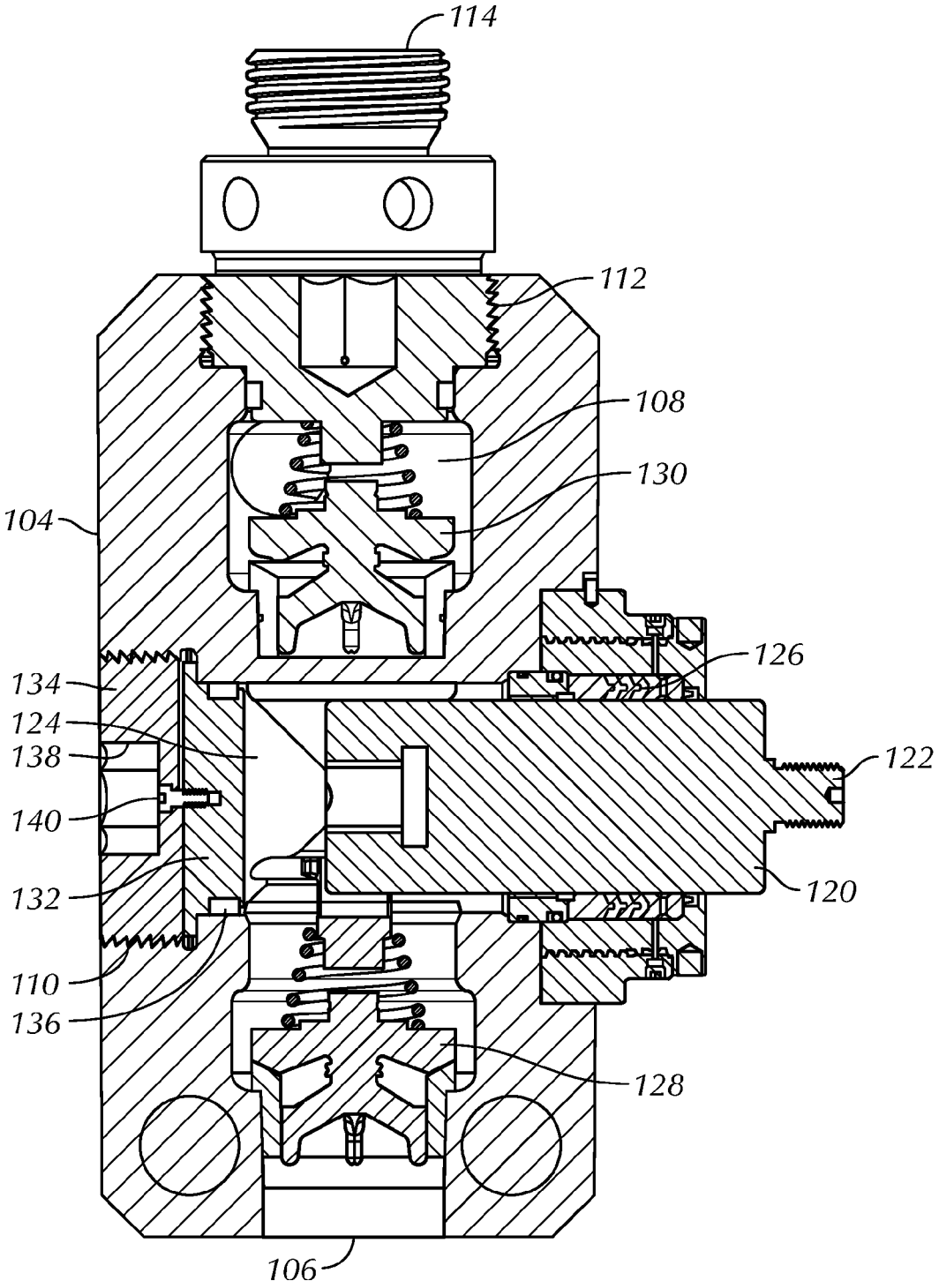
FIG. 2 (Prior Art)
FIG. 2 is a sectioned-view drawing of the fluid end of the well service pump of FIG. 1.

Referring now to FIGS. 3-9 together, the installation, use, and removal of cover assembly 200 with an industrial machine (e.g., a mud pump as shown in FIGS. 1 and 2) can be described. To assembly cover assembly 200 within an access port (e.g., 238 of FIG. 7) of an industrial machine, cover 202 with a seal in groove 212 (if required) is engaged, distal end 208 first, into access port 238 until the seal is compressed into engagement with through bore 246. As cover 202 is further engaged within port 238 an operator rotates cover 202 about its axis until indexing devices (e.g., dowel pins 232 of FIG. 4 and holes 242 of FIG. 7) are aligned such that cover 202 may fully engage rabbet shoulder 242.

With shoulder or flange of cover 202 seated within rabbet shoulder 242 indexing devices aligned, seal (if present) is fully engaged within bore 246 of port 238 and cover 202 is ready to be retained by retainer 204 and key 206. Following seating of cover 202, retainer 204 is threaded into counter bore 244 of access port 238 until the distal end 250 of retainer 204 abuts proximal end 210 to restrict removal or movement of cover 202 from or within port 238. At this time, an external torque may be applied to retainer 204 to "seat" cover 202 and retainer 204 within access port 238. Alternatively, retainer 204 may be left "hand tight" so that final tightening may be performed using key 206.

Finally, distal end 262 of key 206 is engaged within profiled keyway 254 of retainer 204 until spring plungers 264 engage the proximal end 210 of cover 202. At this point, final torqueing of key 206 (either with tools or by hand) may be accomplished such that spring plungers 264 align and engage with slots 286 of cover 202. Once so aligned, one or more magnets 266 of anti-rotation mechanism 280 retain key 206 against proximal end 210 of cover 202. Once so arranged, rotation of cover 202 relative to access port 238 is restricted by indexing devices (e.g., dowel pins 232 of FIG. 4 and holes 242 of FIG. 7), rotation of retainer 204 relative to key 206 is restricted by profile keyway 254, and rotation of cover 202 relative to key 206 is restricted by anti-rotation mechanism 280.

Advantageously, apparatus and method embodiments disclosed herein provide a positive interlock to prevent undesired loosening of a cover for an access port of an industrial machine. Embodiments disclosed herein provide such interlock without requiring fasteners or specialty tools, while allowing simplified removal of the cover by simply retrieving the magnetically held key from the cover through the profiled keyway. Once so retrieved, embodiments disclosed herein allow for the retainer to be threaded out of engagement with the cover so that the formerly-restrained cover may be removed, serviced, and/or replaced. Additionally, embodiments disclosed herein advantageously contain a "fail safe" engagement mechanism, whereby should spring plungers and slots of the anti-rotation mechanism not engage fully, they will automatically engage with slight rotation of the retainer. Thus, should the cover assembly not be fully seated and locked into place initially, as soon as the industrial machine begins service (e.g., vibrates from use), the cover assembly will "self-heal" and fully engage on its own.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

I claim:

1. An apparatus to block an access port of a pump, the apparatus comprising:

a cover having a distal end and a proximal end, wherein the distal end is configured to be received into the access port;

an indexing device to prevent rotation of the cover with respect to the access port;

a first component of an anti-rotation mechanism located upon the proximal end of the cover, a retainer configured to rotatably engage the proximal end of the cover to resist removal of the cover from the access port;

a key to engage the proximal end of the cover through a profiled keyway of the retainer, wherein the key comprises a second component of the anti-rotation mechanism; and at least one magnet to retain the key against the proximal end of the cover, wherein the profiled keyway is configured to restrict rotation of the key with respect to the retainer.

2. The apparatus of claim 1, wherein:

the first component of the anti-rotation mechanism is one of a pin and an aperture; and the second component of the anti-rotation mechanism is the other of the pin and the aperture.

3. The apparatus of claim 2, wherein the pin comprises a spring plunger.

4. The apparatus of claim 2, wherein the aperture comprises a slot.

5. The apparatus of claim 1, wherein the anti-rotation mechanism is configured to restrict rotation between the key and the cover.

6. The apparatus of claim 1, wherein the key comprises the magnet.

7. The apparatus of claim 1, wherein the cover comprises the magnet.

8. The apparatus of claim 1, wherein the indexing device comprises a dowel pin.

9. The apparatus of claim 1, wherein the profiled keyway comprises a polygonal profile.

10. The apparatus of claim 9, wherein the key comprises a polygonal outer profile.

11. A method to block an access port of a pump, the method comprising:

engaging a cover into the access port;

restricting rotation of the cover with respect to the access port with an indexing device;

rotatably engaging the cover with a retainer;

engaging a key with the cover through a profiled keyway of the retainer;

maintaining the engagement of the key with the cover with a magnet;

restricting rotation between the key and the cover with an anti-rotation mechanism; and restricting rotation between the key and the retainer with the profiled keyway.

12. The method of claim 11, further comprising rotatably engaging the retainer against the cover using the key.

13. The method of claim 11, wherein restricting rotation of the cover with respect to the access port comprises engaging a dowel pin with an aperture.

14. The method of claim 11, wherein restricting rotation between the key and the cover comprises engaging a spring plunger with a radial slot.

15. The method of claim 11, wherein restricting rotation between the key and the cover comprises engaging a dowel pin with an aperture.

16. An apparatus to block an access port of a pump, the apparatus comprising:

a cover having a distal end and a proximal end, wherein the distal end is configured to be received into the access port;

a first means for preventing rotation of the cover with respect to the access port;

a first component of a second means for preventing rotation located upon the proximal end of the cover;

a retainer configured to rotatably engage and abut the proximal end of the cover to resist removal of the cover from the access port;

a key to engage the proximal end of the cover through a profiled keyway of the retainer, wherein the key comprises a second component of second means for preventing rotation; and at least one magnet to retain the key against the proximal end of the cover, wherein the profiled keyway is configured to restrict rotation of the key with respect to the retainer.

17. The apparatus of claim 16, wherein:

the first component of the second means for preventing rotation is one of a pin and an aperture; and the second component of the second means for preventing rotation is the other of the pin and the aperture.

18. The apparatus of claim 17, wherein the first means for preventing rotation comprises a dowel pin.

* * * * *